US011246417B2

(12) United States Patent
Raizman

(10) Patent No.: US 11,246,417 B2
(45) Date of Patent: Feb. 15, 2022

(54) TILT-SWIVEL MECHANISM CHAIR

(71) Applicant: Chen Raizman, Kefar Saba (IL)

(72) Inventor: Chen Raizman, Kefar Saba (IL)

( * ) Notice: Subject to any disclaimer, the term of this patent is extended or adjusted under 35 U.S.C. 154(b) by 0 days.

(21) Appl. No.: 16/987,702

(22) Filed: Aug. 7, 2020

(65) Prior Publication Data

US 2021/0037978 A1 Feb. 11, 2021

Related U.S. Application Data

(60) Provisional application No. 62/883,979, filed on Aug. 7, 2019.

(51) Int. Cl.

| | |
|---|---|
| ***A47C 1/032*** | (2006.01) |
| ***A47C 3/18*** | (2006.01) |
| ***A47C 3/20*** | (2006.01) |

(52) U.S. Cl.

CPC ..... *A47C 1/03266* (2013.01); *A47C 1/03216* (2013.01); *A47C 1/03255* (2013.01); *A47C 1/03283* (2013.01); *A47C 3/18* (2013.01); *A47C 3/20* (2013.01)

(58) Field of Classification Search

CPC ... A47C 1/03255; A47C 1/03266; A47C 3/18; A47C 3/20; A47C 1/03216; A47C 1/03283

USPC ..... 297/300.2, 300.3

See application file for complete search history.

(56) References Cited

U.S. PATENT DOCUMENTS

| | | | | | |
|---|---|---|---|---|---|
| 4,270,797 | A * | 6/1981 | Brauning | A47C 1/03272 | 297/300.3 |
| 4,596,421 | A * | 6/1986 | Schmitz | A47C 1/03255 | 297/316 |
| 5,564,783 | A * | 10/1996 | Elzenbeck | A47C 1/03272 | 297/300.2 |
| 5,630,647 | A * | 5/1997 | Heidmann | A47C 13/005 | 297/303.3 |
| 5,871,256 | A * | 2/1999 | Kogai | A47C 1/03255 | 297/300.2 |
| 5,909,924 | A * | 6/1999 | Roslund, Jr. | A47C 1/03266 | 297/300.4 |
| 5,951,109 | A * | 9/1999 | Roslund, Jr | A47C 1/03266 | 297/383 |
| 6,000,756 | A * | 12/1999 | Hybarger | A47C 1/03266 | 297/300.8 |
| 6,609,755 | B2 * | 8/2003 | Koepke | A47C 31/126 | 297/300.2 |
| 6,945,603 | B2 * | 9/2005 | Elzenbeck | A47C 1/03266 | 297/303.4 |

(Continued)

*Primary Examiner* — Rodney B White

(74) *Attorney, Agent, or Firm* — Bay State IP, LLC

(57) ABSTRACT

A tilt-swivel chair employing a bearing base assembly in communication with connection plate or seat plate of the chair is provided. The tilting mechanism in forward and backward direction is provided by the spring which has a pushing and pulling action and the swiveling action is done along the side axis of the bearing base assembly, and the side axis is a cylindrical shape section with a bushing cap onto which a lever base is equipped and is connected to the connection plate or seat plate. The balance ball feeling is provided with the spring action. A cam and lever mechanism is provided at the base of the side axis in corporation with the base section of the assembly. The cam and lever mechanism provides a smooth swiveling action to the seat and to lock and shut down and take a break.

23 Claims, 7 Drawing Sheets

(56) References Cited

U.S. PATENT DOCUMENTS

| | | | | |
|---|---|---|---|---|
| 7,530,639 | B2 * | 5/2009 | Groelsma | A47C 7/506 297/423.38 |
| 7,665,805 | B2 * | 2/2010 | Ueda | A47C 1/03255 297/301.6 |
| 7,726,740 | B2 * | 6/2010 | Masunaga | A47C 1/03261 297/303.3 |
| 8,985,688 | B2 * | 3/2015 | Gorgi | A47C 1/03283 297/303.2 |
| 9,089,217 | B2 * | 7/2015 | Archambault | A47C 3/20 |
| 9,155,391 | B2 * | 10/2015 | Klinke | F16H 25/2021 |
| 10,390,622 | B2 * | 8/2019 | Vidrean | A47C 7/72 |

* cited by examiner

TILT-SWIVEL MECHANISM CHAIR

CROSS REFERENCE TO RELATED APPLICATION

This application claims the benefit of and takes priority from U.S. Provisional Patent Application Ser. No. 62/883,979 filed on Aug. 7, 2019, the contents of which are herein incorporated by reference.

BACKGROUND OF THE INVENTION

Field of the Invention

The present invention relates to flexible structures employed in offices and other work places. More specifically the present invention relates to devices such as office chairs having a swivel and tilt mechanism with flexibility provided to give a balance ball feeling while the mechanism of the present invention improves blood circulation and prevents sitting disease symptoms.

Description of the Related Art

An occupant of a chair, such as an office chair, does not remain stationary throughout the course of the day. The occupant is frequently required to change position, whether to move the occupant's spatial position on the floor, or to rotate to face sideward or rearward, or to reach for an object positioned away from the occupant. Also, a board such as a drawing board, writing board, stool do not have a ball balance feeling to the user.

To an extent, modern desk chairs address these mobility concerns by providing caster wheels on the base (allowing spatial positioning) and by providing a swivel means immediately below the seat part of the chair (allowing the occupant to face in different directions). However, chair designers have had difficulty addressing the reach concern without compromising the comfort or safety of the occupant.

A variety of reclining swiveling task chairs with typical mechanisms are being used in offices and other work places. The swivel mechanism provides the user to adjust the height of the chair to a working level or any desirable height. Some of the chairs are also configured to have a tilting mechanism to allow the tilting of the seat forwards and rearwards with the backrest provided to allow the user when employing a rearward tilt or either a forward tilt to rest or lean the lower back towards the backrest of the chair. The mechanism where the chairs have the backrest or back-support pivotally arranged to a seat in a conventional manner and the movement of the backrest relative to the seat can create shear force which clearly acts on the lower back and the legs of the user leading to a lower back-pain and thigh pain of the user. The shear force generated by the leaning of the back towards the backrest of the chair is unaligned force which pushes one part of the user body in one specific direction and the other part of the body in the other direct and there results the lower back pain which is transferred through the spinal cord of the user.

The ergonomics of the chairs at the work places is an important criterion being overlooked for years. A number of efforts have been employed to enhance the comfort of the user and to promote ergonomically healthy seating for a prolonged duration in offices or other work places. The fundamental requirements for the chair to be an ergonomic are that it should have at least these requirements such as seat height adjustment, seat depth adjustment or seat slider, back rest height adjustment, swivel base, back angle adjustment and the like. These kind of mechanisms are usually provided with the chairs but with poor adjustment of the links such as the synchronization of the seat with respect to the back rest is provided with these conventional ergonomic chairs but this synchronization of tilting and the swiveling is at different rates with generally back tilting at a greater rate than the seat. Generally, the synchronization of the tilt-swiveling chairs is configured to a four-bar linkage or three-bar slide linkage. In a three-bar slide configuration, the sliding path is typically linear. This kind of chair often have a bulky structure with multiplicity of components and the parts that can be difficult to assemble and time consuming and requires a lot of fasteners or joints to connect the components resulting in bulky structure.

In addition, many chairs with a backrest for the office work with the backrest inclined rearwardly and are constructed such that the backrest is mounted inclinable on a support base supporting a seat with a resiliently urging mechanism to urge the backrest forward. Another type of chair is constructed with the seat and the backrest being an integral part in which the front end is supported inclinable on the front end of the support base with the resiliently urging mechanism to urge the seat and the backrest in a desirable direction. The limitation with these kinds of chairs is that when a rearwardly directed pressure is applied to the backrest, only the backrest or both the backrest and the seat are rearwardly inclined against the urging force so that the chair can take a rest position. The center of gravity of the user is greatly shifted rearwardly relative to a support base provided on the leg and the user is likely to fall down rearwardly.

Different kinds of needs arise with a chair to adjust and to accommodate for the user such as size. An office or any class of chair is desirable to have a proper armrest with vertical adjustment capabilities, lateral adjustment capabilities and pivotable adjustment capabilities in a vertical plane. These combinations are merely provided in the current ergonomic chairs as these capabilities in combination employ a complex structure, moving parts assembled together being expensive to manufacture. Current ergonomic chairs provide vertical adjustment capabilities and employ a support member that extends vertically down along the side of the chair, wherein the armrest or the support member interferes with the legs of the user and other objects as the user has a movement on the chair. Moreover, the range of the adjustment is typically limited to the length of the support member and if the support member is large or extends below the seating surface the mobility of the chair is interfered. The ergonomics of the chairs currently have a vast scale of measurement depending mainly upon the comfort, the structure, size and the expenses.

Chairs with adjustable seat depths often employ devices and mechanisms to shift the entire seat in a forward and rearward direction relative to the backrest. Therefore, such chairs must provide for structure to allow the seat to move relative to the backrest while at the same time bearing the load of the seat and user. Moreover, such chairs typically must employ an extra support member which allows the seat to move thereon, for example, when the seat or support member is integrated into the linkage assembly.

Long hours of sitting in office or any other work place creates generally lower back and joints pain with reason being of less movement of the body parts. When there is less stretching of body parts of the user, it leads to improper growth of abdomen and upper thighs. Although the swivel and tilt mechanism provided in the office chairs may somehow provide a movement to some body parts but does not provide a balancing action or feeling automatically without actively making the user to do some physical work. In many countries different surveys have been done in the office for working people sitting for a prolonged duration on a chair, and as the work is necessary so the chairs must be designed to have some action of wiggling and giggling so that there is a proper blood circulation and hence less diseases.

In one of closest art, US'539A1 discloses a chair equipped with a leg column, a seat, and a back support. An intermediate supporting member is fitted to an upper end of the leg column, the seat and a back frame are fitted to the intermediate supporting member, and the back support is fitted to an upper end of the back frame via a joint unit. The seat has an elongated shape when viewed from the top, and is fitted to the intermediate supporting member to swivel horizontally. The back support can be turned freely around a first axis and also can be turned freely around a second axis. Since the seat and the back support can be changed into various modes, a using mode of the chair can be changed variously. However, the art does not disclose of a mechanism to shut or wrap the chair down to take a break.

In another closely related art, US' 7610 discloses a chair with a swivel seat and backrest includes a base support having a central portion on which is vertically mounted a hydraulic cylinder, the hydraulic cylinder having an upwardly extending piston rod, a seat having a bottom provided with a base frame, a first gear disposed under the base frame, a backrest having a lower portion provided with a support member, the supporting member having a lower end provided with a second gear meshed with the first gear, a bracket including an upper mounting and a lower mounting, the upper mounting having a top provided with two vertical bolts, one of the vertical bolts extending upwardly through the first gear to engage with the base frame, another one of the vertical bolts extending upwardly through the second gear to engage with the supporting member, the lower mounting being fixedly connected with the upper mounting having a downwardly extending tubular portion receiving the piston rod, and two armrests fixedly mounted on two opposite sides of the backrest, whereby the seat and the backrest can be rotated in opposite directions as desired thereby making it able to give exercise to an user's lumbar. However, the disclosed mechanism fails to disclose about the movement of a user of chair while sitting and activating the core muscles (back and abdominal), activating both feet in order to balance the body.

In another closest art, US'6690 disclose a height adjustable work chair comprising a seat, a base, and a non-swiveling height adjustment column disposed intermediate the base and the seat. The height adjustment column comprises at least two telescoping height adjustment mechanisms, wherein the telescoping height adjustment mechanisms secure the seat against rotation in relation to the chair base. The work chair additionally comprises means to actuate the height adjustment mechanisms. However, the discussed art does not discuss about a mechanism to get rid of back and joints pain of a user which is highly needed.

Ideally, an ergonomic chair should be able to move in different directions, also in the horizontal plane, as is the case with an exercise ball, for example. Therefore, there is a desire and need to have an ergonomic sitting in the form of a mobility of the entire body, the sitting position can be changed as desired and the spine remains in motion. Such mobility prevents tension that could cause serious disc damage. Additionally, there is a desire and need for a mechanism to achieve the exercise ball balance for plurality of applications such as balancing a board to draw and write. Finally, there is also a desire and need for a swiveling and tilting mechanism that does allow an apparatus using the mechanism stops in a balanced position, and also the mechanism allows the apparatus to stop in different tilting positions and may be used to build a tilt swivel base board, tilt swivel TV cabinet, TV display base, video display device, advertisement board or any wall mounted apparatus.

In view of above aforementioned problems, a novel mechanism is strictly needed which can be adapted or used with any manufacturer chair to give a balance ball feeling and make any user of chair user does not need to actively use, rather it is making his body work automatically.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, discloses a mechanism which is adaptable and can be used with any working chair. The mechanism disclosed provides the feeling and benefits of sitting on a balance ball, but looks like a regular office chair. The invention is novel such that the mechanism does not need the user to use force to activate it, rather the user needs to be active in order to properly sit.

In one of the preferred embodiments of invention, the mechanism of the bearing base assembly allows the user to shut the tilting and swiveling mechanism down.

In another preferred embodiment of the invention, the mechanism of the bearing base assembly and the chair-chair connection mechanism allows that a user does not need to actively use the mechanism of the present invention, rather the mechanism of the chair makes his body to work automatically.

In another embodiment of the invention a spring is disposed in the lateral section of the bearing assembly, which performs a pushing and pulling function, when the tilting of a seat chair either rearwardly or forwardly is done by the user and provide a balancing ball comfort to the user. The bushings provided at the bottom of the pushing and pulling spring provide stability during the tilting of the chair. A side axis is installed vertically proximal to the spring assembly and is connected to the chair-chair mechanism connection or seat plate of the chair. The side axis may be a hydraulic cylinder or a pneumatic cylinder as in conventional sliding and tilting chairs provided a lever base at the top portion of the side axis. The swiveling action of the seat is performed along the side axis of the chair.

In another preferred embodiment of the invention a bearing base of main, lower and upper into which the bushing is installed and upon which pushing and pulling spring is installed for the tilting action with a balance ball feeling is disclosed. A cam and lever mechanism is provided at the base of the side axis in corporation with the base section of the assembly. A plurality of screw nuts is provided at the upper and lower bearing base of the assembly. A number of screw flat nuts are also provided at the base of the bearing base assembly. The cam and lever mechanism provides a smooth swiveling action to the seat and to lock and shut down and take a break. Further the cam and lever mechanism in corporation with the spring assembly provides a balancing ball action through tilting action.

In another embodiment of the invention a backrest connecting flange as displayed like an extruded portion of the base plate provides a smooth forward and rearward motion to the backrest of the chair during the tilting and swiveling action of the user chair. The connecting bearing to seat plate is provided to be connected to the bearing base assembly of the swivel-tilt chair.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE SEVERAL EMBODIMENTS

Figure 1:
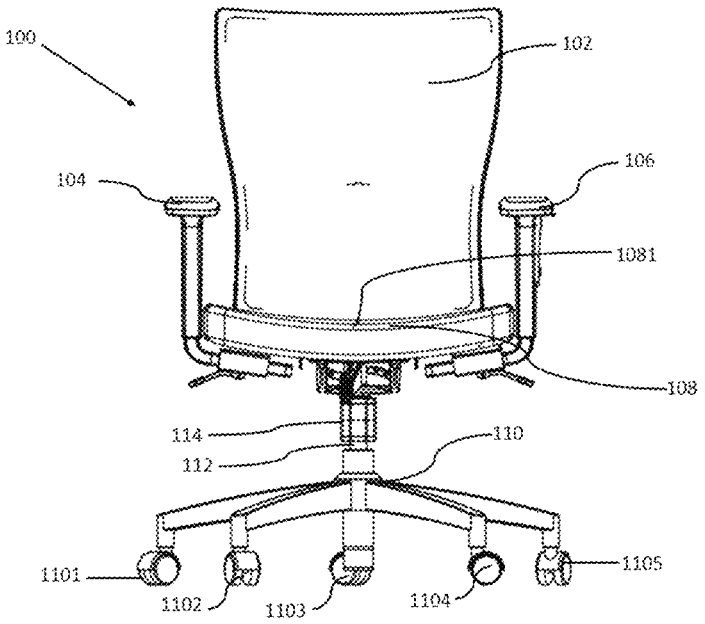
FIG. 1 illustrates a front view of the swivel-tilt mechanism chair of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention or do not limit the scope of the invention. Additionally, an illustrated embodiment need not have all the aspects or advantages shown. Thus, in other embodiments, any of the features described herein from different embodiments may be combined.

The tilting-swivel chair mechanism as displayed in the figures is constructed in accordance with the present invention. The mechanism in the present invention has three axis of movement such as tilting mechanism which gives a balance ball feeling, when a user properly sits on the chair by touching both the feet to the ground and balance themselves with the lower back and abs muscles. This balancing act automatically lets the body properly sit upright which improves the circulation of the blood in the body and prevents from the symptoms of the disease. The swiveling mechanism of the chair allows the user to move around the center axis with movement of the feet, this movement work continuously and cannot be stopped, the user moves the hip while the feet are on the floor, thus increasing blood circulation and moving the joints in the knees and ankles.

FIG. 1 illustrates a front view of the swivel-tilt mechanism chair of the present invention as per the disclosed architecture. The swivel-tilt mechanism chair 100 of the present invention comprises a backrest 102, right arm rest 104, left arm rest 106, a, seat 108, a base 110 containing rollers/wheels 1101, 1102, 1103, 1104 and 1105, a hydraulic or pneumatic cylinder 112 which rotates inside a bushing 114 and performs swiveling or rotating action of the chair 100. When a user sits on the seat 108, the swivel action allows the user to move around the center axis by using feet on floor. The seat 108 has a front, a rear, left and right sides a top and a bottom side. Top section 1081 of seat 108 typically is formed of a cushion material on which a person may sit. The user can move the hip placed on the top section 1081 in clockwise or anti-clockwise direction, while keeping the feet on the floor at a particular position. The movement of the user's leg improves physical hygiene by increasing the blood circulation. The joints of the knees and the ankles are also moved which gives a flexibility to the joints and improves joint fluid and hence improves health. The tilting is a free movement that gives a balance ball feeling when the mechanism of tilting is on. The user needs to properly sit on the chair seat 108 by keeping both the feet on the floor and balance themselves with the lower back and the abs muscles. The balancing act of the swivel-tilt chair 100 automatically lets the body to properly sit upright. This upright position of the body during the balancing action or tilting action improves the blood circulation 11 and helps the user in preventing any symptoms of sitting diseases such as obese body, and the like. Further, the height of the chair 100 is controlled from a regular feet-controlled piston.

Figure 2:
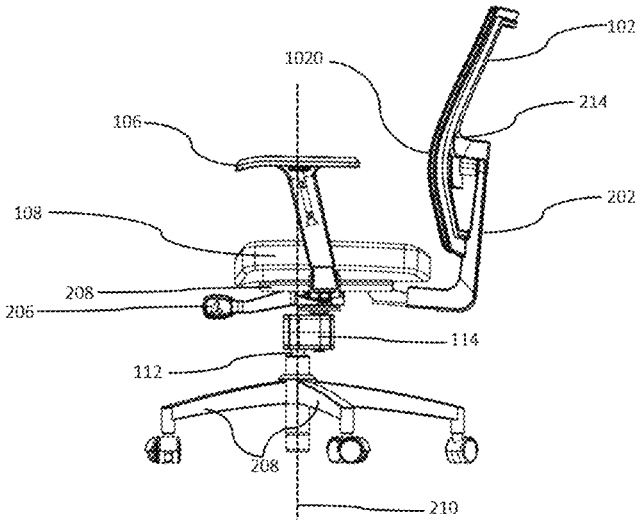
FIG. 2 illustrates a side isometric view of the swivel-tilt chair of the present invention in accordance with the disclosed architecture.

FIG. 2 illustrates a side isometric view of the swivel-tilt chair of the present invention in accordance with the disclosed architecture. As shown in the FIG. 2, the swivel-tilt chair 100 discloses a backrest 102 with a convex structure 1020 to provide a comfortable feeling to the back and shoulder of a user. The backrest 102 is offset from a center line 210 of the swiveling action line of the chair 100. The backrest 102 defines a partial spherical convex surface 1020 to support the back of the user. A control lever 206 is also shown to control the tilting mechanism in a forward direction or a backward direction from the rest position of the chair 100. The right armrest 104 and/or left armrest 106 can also be adjusted in a vertical direction using a force in downward direction on the armrests 104 and/or 106 respectively. The chair 100 swivels around the center line 210 in 360 degrees when the user properly sits on the chair seat 108 by keeping both the feet on the floor and balance with the lower, back and the abs muscles. The backrest 102 is connected to the chair-Chair mechanism plate 208 using a fastening mechanism such as bolt fasteners. Backrest 102 extends upwardly and generally vertically from adjacent rear of seat 108 and is secured to assembly 214 via an L-shaped connector 202 which has an upwardly extending leg secured adjacent the lower end of rear of backrest 102 and a forward extending leg which is secured adjacent its front terminal end to chair-chair mechanism plate 208. The chair 100 is rotated along the central line 210 using a hydraulic or pneumatic cylinder 112 which rotates inside the bushing 114.

Figure 3:
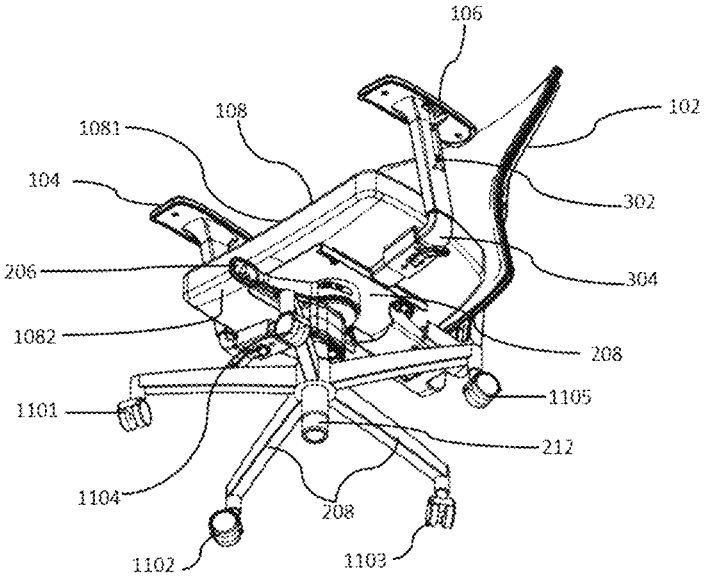
FIG. 3 illustrates a perspective view generally from the bottom of the swivel-tilt chair utilizing the tilt assembly of the present invention in accordance with the disclosed architecture.

FIG. 3 illustrates a perspective view generally from the bottom of the swivel-tilt chair utilizing the tilt assembly of the present invention. The movement of the chair 100 along the floor is provided by a plurality of roller casters 1101, 1102, 1103, 1104 and 1105. The roller casters or wheels 1101, 1102, 1103, 1104 and 1105 may be double rollers or single roller as per the requirements of the user. The arm rests 104, 106 provided on both sides of the seat 108 is connected to the chair-chair mechanism plate 208 with an adjustment mechanism 302 to adjust the height of the arm rest 104 and/or 106 accordingly. A height adjustment handle portion 302 is provided on a lower side of each arm elbow 104 and 106 to adjust the height of the armrest. The elbow or L-section 304 of the arm rest 104, 106 is connected on the both sides of the chair-chair plate 208 through a fastening mechanism such as bolt fasteners. The height adjustment handle portion 302 of the arm rest 104, 106 may use height adjustment mechanisms known in the art may also be used. The seat 108 has a front, a rear, left and right sides, a top and a bottom section. Top section 1081 of the seat 108 is typically formed of a cushion material on which a person may sit while a bottom section 1082 is typically formed of a rigid material to which a chair-chair plate 208 is secured through fastening mechanism such as bold fasteners. Other fastening mechanisms may also be used as per the requirements of the user.

Figure 4:
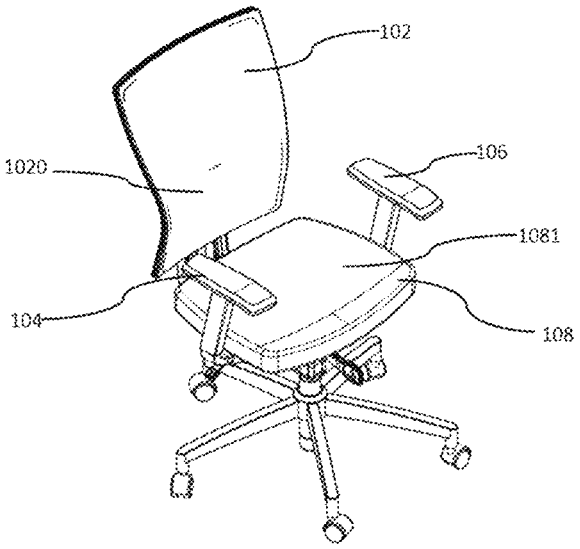
FIG. 4 illustrates a perspective view generally from the top of the swivel-tilt chair utilizing the tilt assembly of the present invention in accordance with the disclosed architecture.

FIG. 4 illustrates a perspective view generally from the top of the swivel-tilt chair utilizing the tilt assembly of the present invention. The armrests 104, 106 are made up of plastic, silicon or any other material which is durable and soft and have dimensions suitable for an arm to be conveniently put on the armrest. Further, the armrests 104, 106 can be adjusted in height as per the needs and desires of the user. As visible, the backrest 102 has a convex shaped structure 1020 to support user's shoulders and back. The seat 108 has dimensions suitable for the user to sit comfortably. The seat 108 may be flat or concave in shape to give required comfort to the user.

Figure 5:
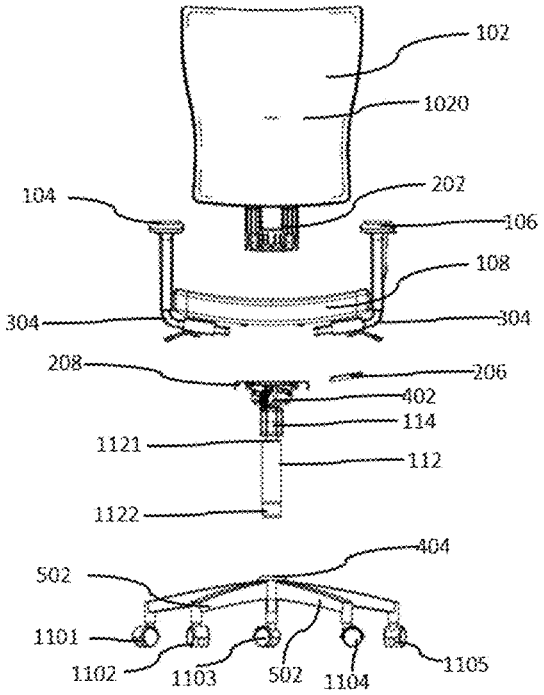
FIG. 5 illustrates a front exploded view of the swivel-tilt mechanism chair of the present invention as per the disclosed architecture.

FIG. 5 illustrates a front exploded view of the swivel-tilt mechanism chair of the present invention. As shown in FIG. 5, the three sections of the swivel-tilt mechanism chair 100 are displayed. An upper section comprising backrest 102 having a convex shape 1020 and a backrest connecting flange 202 to connect the backrest to a chair-chair plate 208, the middle section disclosing the concave seat 108 and the arm rests 104, 106 with their elbows or L-sections 304 which are connected to the bottom plate or the chair-chair plate 208. The upper section of the present invention comprising the chair assembly 102 is replaceable and other assembly may be attached to the plate 208 as per the user desires. For example, a base board may be attached to the plate 208, that enables the base board to tilt or swivel as per the needs and requirements of the user. The base board may be used by the user for drawing, writing or tutorial purposes. In other embodiments, a tilt swivel base board, tilt swivel TV cabinet, TV display base, video display device, advertisement boards or any mountable apparatus may be attached to the plate 208 for serving different purposes to the user.

The lower section includes chair-chair plate 208 to which the concave seat 108 is attached on an upper side and hearing assembly 402 is attached to a lower side of the chair-chair plate 208. A control lever or handle 206 is attached to the chair-chair plate 208 to control the tilt of the concave seat 108 of the chair 100. On the lower side of the bearing assembly 402 a cylinder which can be pneumatic or hydraulic cylinder 112 to adjust the concave seat 108. An upper end 1121 of the cylinder 112 is attached to the bushing 114 a lower end 1122 of the cylinder 112 is attached to a wheel flange 404 to which a number of rollers 1101, 1102, 1103, 1104 and 1105 are attached through legs 502.

As shown in FIG. 5, a clocking bushing 114 is provided to the pneumatic cylinder 112. The bushing 114 preferably, has a tab-in-groove fit with the cylinder 112. The bushing 114 has the function of transferring, swivel motion from the cylinder 112 to the bearing assembly 402, which further leads to swiveling action of the chair 100.

Figure 6:
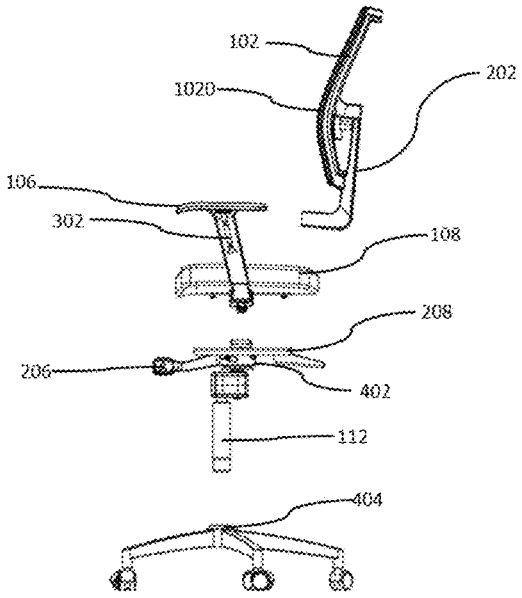
FIG. 6 illustrates a disassembled side view of the swivel-tilt mechanism chair of the present invention as per the disclosed architecture.

FIG. 6 displays a disassembled side view of the swivel-tilt mechanism chair of the present invention. As shown in FIG. 6, the convex shaped 1020 backrest 102 and the concave shaped seat 108 is assembled by utilizing a connecting flange 202 and a chair-chair plate 208 respectively. A handle or a control lever 206 is provided just below the chair-chair plate 208, wherein the handle 206 is an L-shaped rod with a handle on the one end and is attached chair-chair plate. The armrest 106 is attached with a height adjustable mechanism using height adjustment handle portion 302, per the needs and requirements of the user. A cylinder 112 is placed between a wheel flange 404 and a bearing assembly 402 which helps in moving the seat in an upward and downward direction.

Figure 7:
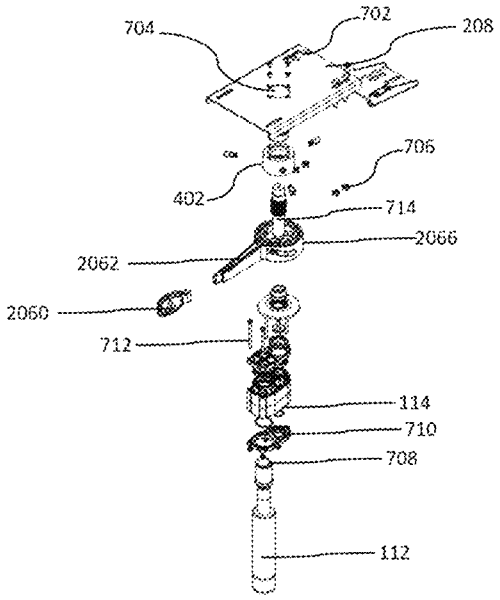
FIG. 7 illustrates a disassembled view of the components of the lower section of the swivel-tilt mechanism chair of the present invention as per the disclosed architecture.

FIG. 7 illustrates a disassembled view of the components of the lower section of the swivel-tilt mechanism chair 100. A lower portion of chair-chair plate 208 is connected to a bearing assembly 402 which on the lower side is connected to a ring-shaped section 2066. The ring-shaped section 2066 provides the swiveling movement of the chair 100. Further, in case a base board is attached to the plate 208, the ring-shaped section 2066 provides the swiveling movement the base board. Alternatively, the ring-shaped section 2066 provides the swiveling movement to a tilt swivel TV cabinet, a TV display base, a video display device, an advertisement boards or any mountable apparatus that is attached to the plate 208 for serving different purposes to the user. The swiveling movement stops only in a balanced position, providing a balance to the body of the attached assembly.

As shown in FIG. 7 the chair-chair plate 208 comprises of holes 702 and a piston 704. The holes 702 are used for attaching the seat 108 (not shown) to the plate 208 and the piston 704 is used for connecting the cylinder 112 to the plate 208. Bolt fasteners 706 are used to fasten the various components of the chair 100. The ring-shaped section 2066 is connected to an extended arm 2062 and a holding section/knob 2060. As described earlier, the cylinder 112 having a bushing cap 708 rotates inside a bushing 114 which has a spring in the lateral section of the bearing assembly 402, which performs a pushing and/or pulling function, when the tilting of a backseat 102 not shown) of the swivel chair 100 either rearwardly or forwardly is done by the user which provides a balancing ball comfort to the user. Components such as Bushing plates 710, screws 712 are used for integrating the components required for swivel and tilt mechanism of the present invention.

Figure 8:
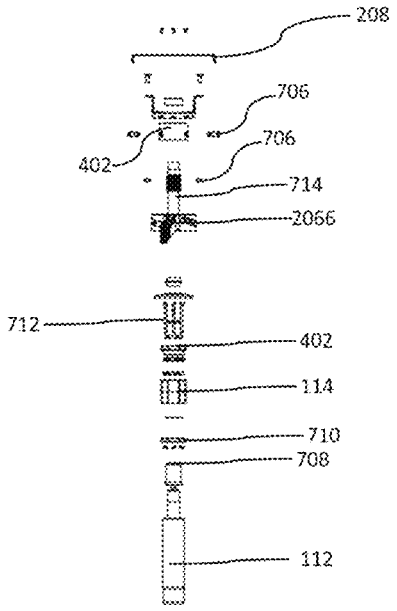
FIG. 8 illustrates a front view of a lower section of the swivel-tilt mechanism chair of the present invention as per the disclosed architecture.

FIG. 8 illustrates a front view of a lower section of the swivel-tilt mechanism chair 100. All the components are assembled to provide a swiveling and/or tilting movement to the chair-chair plate 208 which is connected to the concave shaped seat 102 (not shown) of the swivel-tilt mechanism chair 100. Components such as Bushing plates 710, screws 712 are used for integrating the components required for swivel and tilt mechanism of the present invention.

Figure 9:
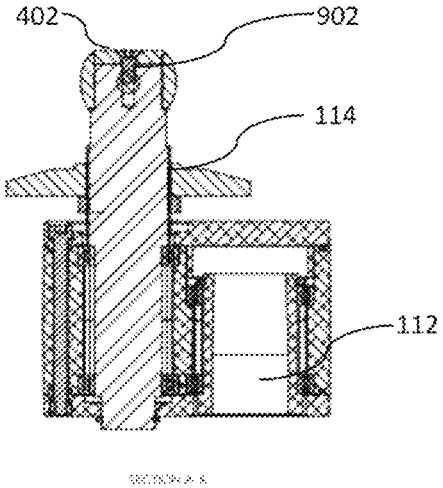
FIG. 9 illustrates a sectional view (A-A) of the bearing base assembly of the swivel-tilt chair of the present invention as per the disclosed architecture.

FIG. 9 illustrates a sectional view (A-A) of the bearing base assembly 402 of the swivel-tilt chair 100. A spring 902 is disposed in a lateral section of the bearing assembly 402, which performs a pushing and pulling function, when the tilting of a backseat 102 (not shown) of the chair 100 either rearwardly or forwardly is done by the user and provides a balancing ball comfort to the user. A bushing 114 provided at the bottom of the pushing and pulling spring provide stability during the tilting of the chair 100. The bushing 114 is one classification of the overall category of bearings. The bushing 114 is a thin tube or sleeve that allows relative motion by sliding (our type), as compared to rolling. The bushing might also be called a sleeve bearing. A side axis is installed vertically proximal to the spring assembly 902 and is connected to the chair-chair mechanism connection or seat plate 208 of the chair 100 described later in the description. The side axis may be a hydraulic cylinder or a pneumatic cylinder 112 as in conventional sliding and tilting chairs provided a lever base at the top portion of the side axis. The swiveling action of the seat 108 is performed along the side axis of the chair. The length of the side axis and the total length of the bearing base assembly are but not limited to the example mentioned herein, not less than 150 cm and the diameter of the lever base or the top of the cylinder is not less than 100 mm.

Figure 10:
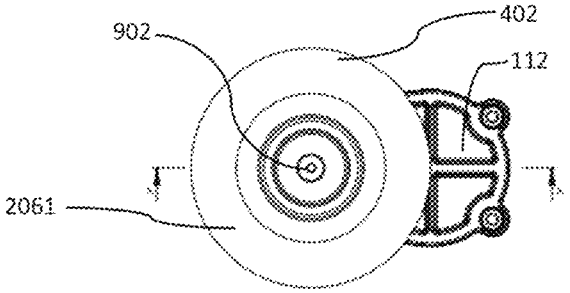
FIG. 10 illustrates a top view of the bearing base assembly along the section A-A assembly of the swivel-tilt chair of the present invention as per the disclosed architecture.

FIG. 10 shows a top view of the bearing base assembly 402 along the section A-A. The top view displays an extended portion Wherein a spring 902 and a bushing assembly are installed into the structure. A lever base 2061 is shown and is connected to the base plate 208 (not shown) of the chair 100 through a connecting bearing mechanism.

Figure 11:
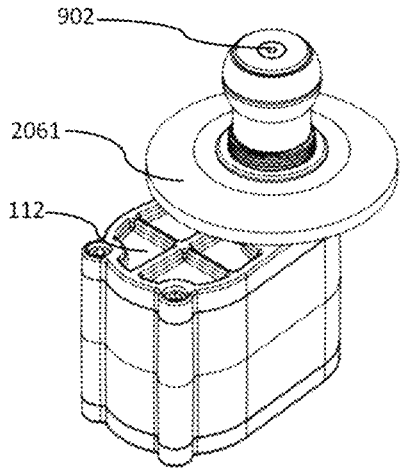
FIG. 11 illustrates a compact view of the bearing base assembly mechanism of the swivel-tilt chair of the present invention as per the disclosed architecture.

FIG. 11 illustrates a compact view of the bearing base assembly mechanism displaying the bases for bearing and lever. The compact or the closed view of the bearing base assembly displays a lever base 2061 which is to be connected through connecting bearing to seat plate by using a spring 902. A bearing main base, a lower bearing base and an upper bearing base are shown into which the bushings and the pushing and pulling spring 902 are installed.

Figure 12:
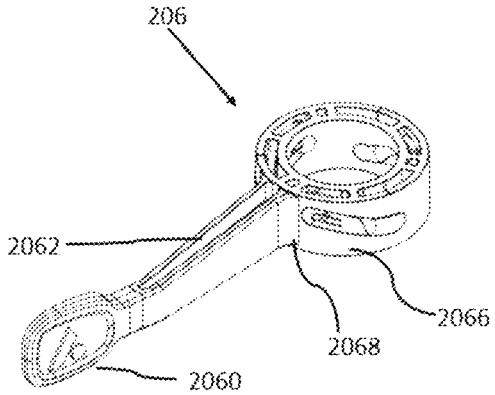
FIG. 12 illustrates a perspective view of a control lever for controlling tilt of seat of the chair and its associated structure.

FIG. 12 illustrates a perspective view of a control lever for controlling tilt of seat of the chair and its associated structure is shown. The control lever 206 has a holding knob 2060 at an end of an arm 2062 which is connected to a ring-shaped section 2066. The handle or arm 2062 is provided at the ring 2066 to control tilt of the seat 108 of the chair 100 as per the needs and requirements of the user. Further, the handle 2062 has a pivotal connection 2068 to the ring-shaped section 2066. The control lever 206 is movable and is adapted to operate tilt control mechanism configured for adjusting and controlling the forward and backward tilt of the chair 100. The handle 206 of the present invention is a manually actuated lever operatively connected to the ring-shaped section 2066. The control lever 206 can tilt the chair 100 between two extreme positions: an extreme forward position in which the seat is tilted forward by about 10° during tasks requiring a forward leaning position; and an extreme backward position in which the seat is tilted backwards by about 25° during tasks requiring a backward leaning position. Between the extreme forward and rear positions, the chair is infinitely adjustable by its occupant/user.

In a further embodiment of the present invention, a base board is attached to the plate 208, the control lever 206 provides the tilting action to the base board. Alternatively, the control lever 206 provides the tilting movement to a tilt swivel TV cabinet, a TV display base, a video display device, an advertisement boards or any mountable apparatus that is attached to the plate 208 for serving different purposes to the user.

Figure 13:
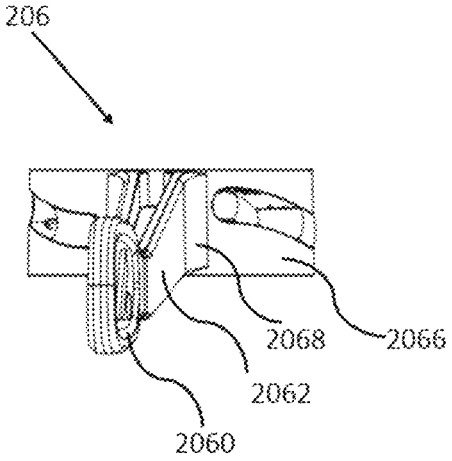
FIG. 13 illustrates a sectional view of control lever for controlling tilt of seat of the chair of the present invention in accordance with the disclosed architecture.

FIG. 13 illustrates a sectional view of control lever for controlling tilt of seat of the chair of the present invention in accordance with the disclosed architecture. As shown in the FIG. 13, on manually activating the control lever 206 through an arm 2062, a tilt of seat 108 of the chair 100 is adjusted and controlled as per the needs and desires of the user. An air chamber in the cylinder 112 (not shown) is connected to a piston that, when activated by pushing the lever 206, moves into the chamber 2068. This action further compresses the air inside the chamber 2068, resulting in a tilting motion that allows the seat 108 of the chair 100.

Figure 14:
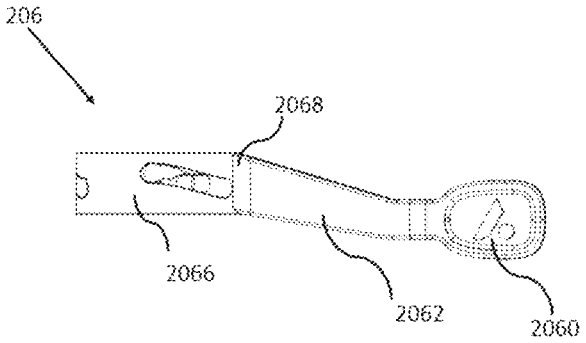
FIG. 14 illustrates a side view of control lever for controlling tilt of seat of the chair of the present invention in accordance with the disclosed architecture.

FIG. 14 illustrates a side view of control lever for controlling tilt of seat of the chair of the present invention in accordance with the disclosed architecture. As shown in the FIG. 14, the arm 2062 is of an extended length having a connected holding section such as a knob 2060. During the operation of the control lever 206, the feet of the user should be flat on the floor or a footrest and the legs should be bent at right angles to the floor.

As described above, the mechanism of the present invention allows three basic motions: swiveling, height adjustment, and tilting. The mechanism is adapted to perform all of the above motions.

The swiveling action performed by the mechanism of the present invention does not allow an apparatus such as a chair to move once it is stopped in a balanced position. Additionally, the swiveling mechanism of the invention may allow the user to balance in different tilting positions.

The bearing ring (such as a race bearing) is provided to facilitate the swiveling of the chair. In addition to swivel motion, the mechanism of the present invention preferably allows height adjustment along the longitudinal axis performed by the cylinder and the coil spring. For tilting, a tilt pressure is applied on the backrest, then, certain parts of the mechanism tilt while the seat remains stationary.

The height of the chair 100 is controlled from a regular feet-controlled piston which can be easily and conveniently used for adjusting the height as per the desire and needs of the user/occupant.

Additionally, bearing assembly of the present invention allows a seat such as seat 108 to be tilted in any direction relative to a chair base and relative to a backrest 102. In addition, assembly provides hydraulic systems which are capable of providing varying degrees of resistance to this tilting movement, which is useful both in providing exercise for the user as well as limiting the rate at which the tilting occurs for a given amount of weight applied at any given point on seat 108. The hydraulic systems further provide a hydraulic lock for securing the seat in any tilted position while also providing a simple mechanism for automatically leveling the seat support and seat.

The swivel-tilt chair 100 of the present invention has Ergonomic back support and spinal alignment, strengthens the core of the user as the user sits on the seat of the chair 100, is stable yet lightweight and may be made up of molded PVC. The mechanism of the present invention may handle weights up to 400 lbs. The chair, further, has rolling, lockable caster wheels. The chair 100 of the present invention can be suitably used for general office chairs such as computer operation and rehabilitation chairs, as well as health equipment and cradles for lumbar muscle training. Further, the mechanism of the present invention can be used for as a balance board if we attach a board instead of the chair seat. The mechanism stops in the balanced position only and may be stopped in different tilting positions. The mechanism of the present invention may be used to build a tilt swivel base board, tilt swivel TV cabinet, TV display base, video display device or any mountable apparatus as well.

Notwithstanding the forgoing, the swivel-tilt chair 100 of the present invention and its various structural components can be any suitable size and configuration as is known in the art without affecting the overall concept of the invention, provided that it accomplishes the above stated objectives. One of ordinary skill in the art will appreciate that the size of the swivel-tilt chair 100 and its various components, as show in the FIGS. are for illustrative purposes only, and that many other sizes of the swivel-tilt chair 100 are well within the scope of the present disclosure. Although dimensions of the swivel-tilt chair 100 and its components (i.e., length and width) are important design parameters for good performance, the swivel-tilt chair 100 and its components may be any size and color that ensures optimal performance during use and/or that suits user need and/or preference.

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations and equivalents may be resorted to, and such modifications, variations and equivalents are intended to fall within the scope of the invention as described and within the scope of the claims.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A swivel-tilt apparatus comprising:

a bearing base assembly; and a spring assembly disposed at a proximal end of the bearing base assembly;

wherein the bearing base assembly further comprises:

a cylinder having a bushing cap disposed at a distal end of the bearing base assembly along a center line of the apparatus;

a bearing in the form of a bushing rotatably connected to the cylinder, a lever having a ring-shaped section connected to a lower side of the bearing assembly, and a lever base connected at the proximal end of the bearing base assembly to enable a swiveling action; and wherein a lower portion of the lever base is rotatably attached to the proximal end of the bearing base assembly; and a top portion of the lever base is attached to a base plate of the swivel-tilt apparatus.

2. The apparatus of claim 1, further comprising bushings provided at the bottom of the spring.

3. The apparatus of claim 1, wherein the side axis is a hydraulic cylinder or a pneumatic cylinder.

4. The apparatus of claim 1, wherein the swiveling action is performed along the side axis of the chair.

5. The apparatus of claim 1, wherein the bearing assembly has a cam and lever mechanism.

6. The apparatus of claim 1, wherein the swivel-tilt apparatus provides a balancing ball action through a tilting action.

7. The swivel-tilt apparatus of claim 1, wherein the apparatus further comprising:

a chair-chair connecting plate having an upper surface anda lower surface;

a concave seat attached to the upper surface;

a bearing base assembly attached to the lower surface; and a control lever attached to the plate to control tilt of the concave seat.

8. The chair of claim 7, wherein the control lever controls the forward tilt by 10°.

9. The chair of claim 7, wherein the control lever controls the backward tilt by 25°.

10. The chair of claim 7, wherein an upper portion of the cylinder is attached to a bush.

11. The chair of claim 7, wherein a lower portion of the cylinder is attached to a wheel flange to which a number of rollers are attached through legs.

12. The chair of claim 7, wherein a length of the bearing base assembly is between 100 cm-150 cm.

13. The chair of claim 7, wherein a diameter of the bearing base assembly is between 70 mm-100 mm.

14. The chair of claim 7, further comprising a backrest connected through a backrest connecting flange.

15. The backrest connecting flange of claim 14, wherein the backrest connecting flange provides a smooth forward and rearward motion to the backrest during the tilting and swiveling action of the chair.

16. The backrest of claim 14, wherein the backrest is convex shaped to give comfort to the back and shoulders of a user sitting on the chair.

17. A bearing assembly for a balance ball feeling comprising:

a spring to tilt an apparatus having the bearing assembly;

a cam and lever mechanism for providing a smooth swiveling action;

a ring-shaped section connected to a lower side of the bearing assembly; and wherein the ring-shaped section, and the cam and lever mechanism provide a balancing ball action through a tilting action.

18. The bearing assembly of claim 17, further comprising an upper bearing base and a lower bearing base.

19. The bearing assembly of claim 18, wherein the bearing assembly is attached to a lower surface of a base plate through the upper bearing base.

20. The bearing assembly of claim 18, wherein the bearing assembly is attached to a pneumatic or a hydraulic cylinder through the lower bearing base.

21. The bearing assembly of claim 17, wherein a length of the bearing assembly is between 90 cm-150 cm.

22. The bearing assembly of claim 21, wherein the bearing assembly further stops the apparatus in a balanced position.

23. The bearing assembly of claim 17, wherein the bearing assembly further stops the apparatus in different tilting positions.

* * * * *